US005165681A

United States Patent [19]

Enger et al.

[11] Patent Number: 5,165,681

[45] Date of Patent: Nov. 24, 1992

[54] POOL HAND BRIDGE

[76] Inventors: Terry W. Enger, R.R. #1, Box 59, Sheyenne, N. Dak. 58374; Kevin S. Long, P.O. Box 111, Tioga, N. Dak. 58852; Herbert A. Mosher, 821 2nd Ave. NE., Minot, N. Dak. 58701

[21] Appl. No.: 683,077

[22] Filed: Apr. 10, 1991

[51] Int. Cl.[5] ..... A63D 15/10

[52] U.S. Cl. ..... 273/24; 273/17

[58] Field of Search ..... 273/2, 14, 17, 18, 20, 273/24, 23

[56] References Cited

U.S. PATENT DOCUMENTS

| | | | |
|---|---|---|---|
| 211,416 | 1/1879 | McIntire | 273/23 |
| 690,617 | 1/1902 | Rhuland | 273/23 |
| 1,105,478 | 7/1914 | Ames | 273/24 |
| 3,815,876 | 12/1974 | Baker | 273/24 |
| 4,120,495 | 10/1978 | Moughler | 273/23 |
| 4,953,861 | 9/1990 | Ames | 273/23 |

FOREIGN PATENT DOCUMENTS

| | | | |
|---|---|---|---|
| 7466 | of 1884 | United Kingdom | 273/23 |
| 1511450 | 5/1978 | United Kingdom | 273/23 |
| 2131703 | 6/1984 | United Kingdom | 273/23 |

*Primary Examiner*—Theatrice Brown

*Attorney, Agent, or Firm*—Robert E. Kleve

[57] ABSTRACT

The invention comprises a bridge or support for supporting a cue stick on a pool table while striking a cue ball with the cue. The bridge has a rectangular plate with cue supporting notches in each of the four sides of the plate. The plate is held upright by hand on one of the four sides while the operator with his other hand moves the cue stick in the notch on the top side of the plate to strike the cue ball for playing pool. The plate has a gripping surface along a majority of the length of two of the four sides of the plate for gripping the plate with one hand, while sliding the cue in the notch of one of the sides with the other hand. A chalk support opening is provided in the plate for supporting a cube of cue chalk therein.

3 Claims, 1 Drawing Sheet

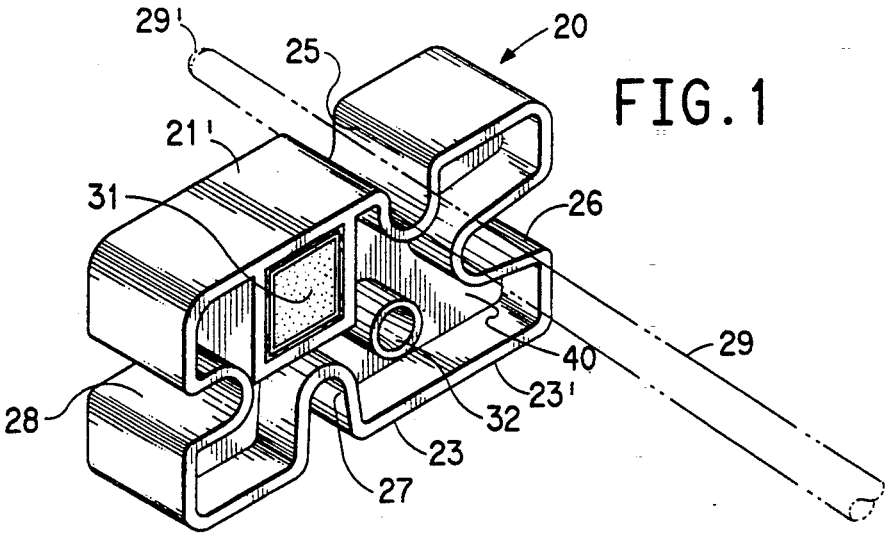
FIG. 1
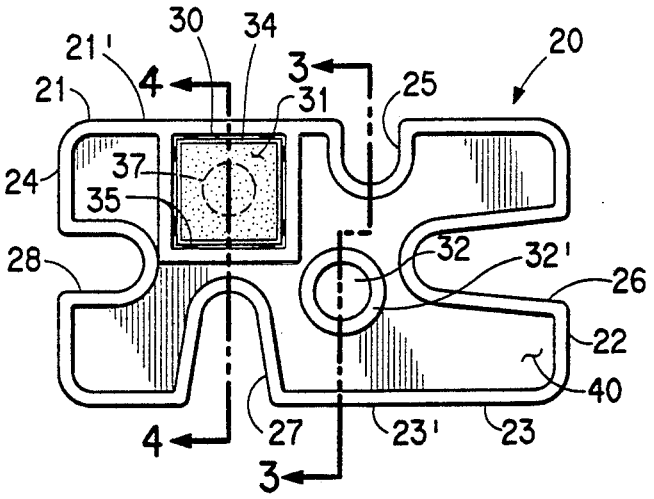
FIG. 2
FIG. 3
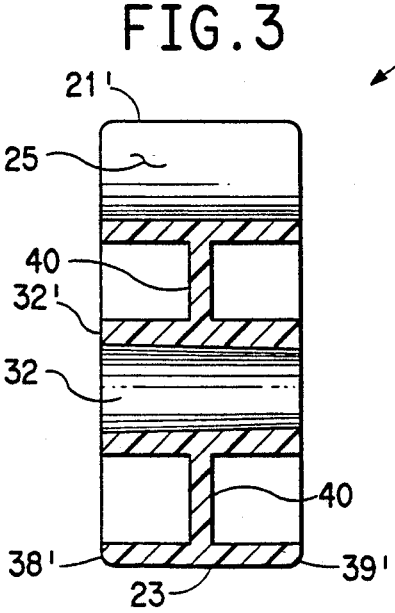
FIG. 4
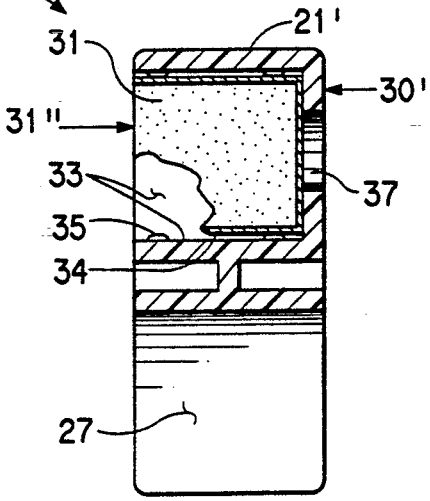

POOL HAND BRIDGE

The invention relates to hand held bridges or supports for supporting a pool cue while sliding the cue or stick across the bridge when striking a ball.

It is an object of the invention to provide a novel support for support a pool cue stick which has hand grasping surfaces for supporting the bridge upright while sliding a cue stick across it to strike a ball, and which has notches of varying heights for striking the ball at varying heights.

It is another object of the invention to provide a novel hand held bridge which can be held upright while sliding a cue stick across it for stiking a ball, which a notch adjacent the supporting surfaces to guide the stick while sliding it across the plate, and a opening to receive and support a cue chalk It is another object of the invention to provide a novel hande held cue bridge which has a rectangular elongated shape and an uninterrupted substantially straight surface along a majority of its length for manually grasping the plate conveniently and for easily supporting the bridge upright.

It as another object of the invention to provide a novel hand held rectangular plate having a substantially uninterrupted horizontal surface along a majority of the length of on of its sides for grasping and supporting the plate upright while sliding a cue stick across it to strike a cue ball. The support plate has a rectangular notch to receive and support a chalk cue while chalking cue stick.

It is another object of the invention to provide a novel hand held bridge for supporting a cue stick while striking a ball which is convenient to operate and has a chalk cube mounted therein.

Further objects and advantages of the invention will become apparent as the description proceeds and when taken in conjunction with the accompanying drawing wherein:

BRIEF DESCRIPTION OF THE DRAWING

FIG. 1 is a perspective view of the hand held bridge invention with the bridge supporting a cue stick.

FIG. 2 is side elevational view of the hand held bridge invention.

FIG. 3 is a cross sectional view of the hand held bridge invention taken along line 3—3 of FIG. 2.

FIG. 4 is a cross sectional view of the bridge or cue support invention taken along line 4—4 of FIG. 2.

BRIEF DESCRIPTION OF PREFERRED EMBODIMENT:

Briefly stated, the invention comprises a hand held bridge invention for playing pool having a rectangular plate with notches at intervals about its four sides, said plate having a substantially uninterrupted straight surface along a majority of the length of at least two of the opposing sides of the plate to provide a hand gripping surface of the majority of the length of these sides to a hand supporting force upon most of the length of the plate support thereby making it easier to support it upright in a secure manner with a minimum of force or effort, said notches in said sides being adjacent the uninterrupted gripping surface, said plate having a square recess for supporting a cube of cue chalk, said plate having a central opening therethrough to receive a cue stick for alternatively supporting the bridge on a cue stick.

Referring more particularly to the drawing, in FIG. 1 the cue support or bridge invention 20 having a rectangular elongated shape with four sides 21,22,23, and 24, and with notches 25,26,27, and 28, and with a cue stick 29 in position for use in the notch 25.

As shown in more detail in FIGS. 2–4, inclusive, the cue support or bridge has a substantially uninterrupted straight surface 21' on the side 21 and a similarly uninterrupted straight surface 23' on the opposing side 23, with both surfaces 21' and 23' extending a majority of the length of their respective surfaces 21 and 23. Both uninterrupted surfaces serve as hand gripping surfaces when holding the plate upright while sliding the cue stick in on of the notches to strike a pool ball.

Within the confines of the four sides is a square recess 30 for holding a cube of cue chalk 31, and centrally of the length and width of the support plate 20 is a conical opening 32 therethrough for receiving the striking end 29' of the pool cue, for supporting the plate 20 on a pool cue rather than by hand, if desired.

The recess 30 for holding the cue chalk cube will have a slight taper to its side walls which taper slightly toward one anther in the direction of the back wall 30' of the recess. Also, the inner surfaces of the four walls 33 forming the interior of the recess will have several small projections 35 of plastic which will frictionally engage the side wall of the paper outsides 34 of the chalk cube to frictionally retain the cube in the recess. The taper will assist in preventing the cube from becoming too locked into the recess frictionally to make it difficult to remove the cube. Also, the back wall 30' will have an opening 37 therethrough so that when it is desired to remove and exchange the chalk cube for an new one, a narrow rod or narrow object can be slid through the opening against the base of the cube 31 to push the cube out the opening 37 at the front of the cube and front of the plate 20 for easy removal of the cube. The front face 31'' of the cue chalk will not be covered with paper so that the operator may engage the felt tip of a cue directly against the chalk at this face 31'' to apply chalk to the felt tip of the cue without having to remove the cube from the plate.

The thickness or width of the plate, from its front edge 38 to its rear edge 39 will be relatively thick, approximately one and one-eighth inch, to its length of approximately four and one half inches, so that the plate when placed upright on one of the four sides 20–24; these sides will have a relatively broad base so that the plate will be relative stable when upright on a pool table for use in supporting a pool cue in one of the notches for striking a pool ball.

OPERATION

The cue support or cue bridge invention 20 will operate substantially as follows:

Each of the notches 25–28 have a different depth with respect to one another, so that when it is desired to shoot a pool cue stick 29 by moving it axially along one of the notches to strike a pool ball, the operator will select one of the notches 25–28 which gives him the height of the cue off the surface of the table that he desires.

If the operator chooses to use the notch 25 to slide the pool cue in to strike the pool ball, he will place the plate or bridge 20 upright on the pool table using the side 24 as the base so that the side 21 is on top, with the plate upright. He will then grasp the support invention, assuming he is right handed, with his left hand by grasping the top surface 20' by placing his fingers of his left hand laterally across the top of the surface 20'. The relatively broad base or width of the plate from front 38 to rear 39, provides a relatively wide area of support for the fingers placed across the top of the plate that will be at least equal or substantially near to the length of many fingers between their joints. Also by the surface 20' being substantially straight and uninterrupted, it will provide a long enough surface or an operator to place several fingers closely adjacent one another across the surface, and since this surface is a majority of the length of the plate apply a physical force upon the plate downward across at locations continously across most of the length of the plate making it easier to support it upright in a secure manner, in constrast to holding the support in position by only a small part of the plate. Then using the support or bridge invention in this position, the operator will slide it with his left hand to its proper position with the notch 25 in front of the ball he wishes to hit with the cue and then place the cue stick in the notch 25 and slide it axially to strike the wall, while holding the plate upright with his left hand as described.

When it is desired to use the notch 27 to support the pool cue, the plate will be reversed placing the surfaces 23 on the bottom, and the operator will grasp the uninterrupted surface 23' with the fingers of his left hand, by placing them laterally across the surface, with the finger adjacent one another, to hold the plate upright while the operator uses the notch to slide the cue in to strike the cue ball.

When using the notch 26 to slide the pool cue in to strike the ball, the operator will grasp the surface 21' with the fingers of his left hand while holding the plate 20 upright using the side 24 of the plate as the bottom or base plate for the plate to rest on the pool surface, and will slide the cue stick in the notch 26 with his left hand to strike the pool ball.

When using the notch 28 to slide the cue stick in to strike the cue ball, the operator will grasp the surface 23' with his left hand and hold the plate upright using the surface 22 as the base so that the surface 24 in on top as is the notch 28 for the cue stick to slide in.

If is is desired to use the bridge spaced further away from the operator, the operator may take a pool cue and insert the striking end of the pool cue into the opening 32. The opening 32 will having a tapered opening of an inside diameter similar to that of the outside diameter of the striking end of the pool cue, so that one will have to slide the striking end of the pool cue into the opening, in many instances, only a relatively short distance in relation to the length of the pool cue before the cue stick and the tapered sleeve 32' forming the opening 32 will engage one another and the cue will freeze or lock in the opening 32, whereupon the operator can use the bridge or plate with the cue stick as a handle to support the plate 20 upright on the pool table while sliding another cue stick in a selected notch to strike a ball.

The plate 20 has a center wall 40 recessed between the sides 25–28, and outside the sides of the cube recess 30 and the tapered sleeve 32'. The recess formed by the center wall enables the tips of the fingers of a hand to be inserted into the recess when grasping the plate laterally across the sides for a more firm grip. Also, the thickness of the sides and the recesses enables the tips of the claws of artificial hands to engage in the recesses for a more firm grip.

Thus, it will be seen that a novel bridge or cue support has been provided which can be hand held while resting on a pool table to support a pool cue and serve as a firm support, and which can also be used to carry a cue chalk therein.

It will be obvious that various changes and departures may be made to the invention without departing from the spirit and scope thereof, and accordingly, it is not intended that the invention be limited to that specifically described in the specification or as illustrated in the drawing, but only as set forth in the appended claims wherein:

What is claimed is:

1. A hand held bridge comprising a narrow substantially rectangular plate forming a rectangular wall, said wall having at least four substantially straight flat outer edge surfaces including two opposing outer edge surfaces and two laterally opposing outer edge surfaces extending laterally to said first mentioned opposing surfaces, each of said outer edge surfaces having a notch with said notches being of varying depth with respect to one another; at least two of said straight flat outer edge surfaces having a substantially uninterrupted straight surface along a majority of its length providing a hand gripping surface, with its one notch in a minor portion of said substantially uninterrupted straight outer edge surface, said uninterrupted gripping surface providing a surface for an operator to grasp with one hand while resting the plate upon one of the outer edge surfaces upright on a pool table and sliding a cue in one of the notches to strike a pool ball with the cue with the notches acting to guide the cue.

2. A hand held bridge according to claim 1 wherein said rectangular plate has side walls forming a rectangular recess, said recess having a back wall defined by one of said side walls and a front wall defined by another of said side walls, said front wall includes an opening of said recess; a pool chalk cube inserted through said opening and being detachably mounted in said recess, said back wall having an opening of reduced size to receive a narrow object therethrough to engage said cube to force said cube out of said front wall opening when replacing said cube; said pool chalk cube and said front wall opening formed by said side walls being larger than a pool cue having a felt tip for enabling the pool cue and its felt tip to be introduced through said front wall opening to be engaged against said chalk cube for chalking the felt tip of the cue.

3. A hand held bridge and chalk retainer plate comprising a narrow substantially rectangular plate having at least four side edge surfaces including two opposing side edge surfaces and two side edge surfaces lateral to the two opposing side edge surfaces; said plate having a substantially straight uninterrupted gripping surface along a majority of the length of at least one of the side edge surfaces, said plate having a notch in each of said side edges, each notch being of varied depth with respect to each other said plate gripping surfaces enabling said bridge to be held upright while resting one of the side edge surfaces upon a pool table while gripping the plate along one of the substantially straight surfaces, and using a pool cue by sliding it in one of the notches to strike a pool ball, said plate further having a depression forming a cubic recess, said recess having a front opening, a cube of cue chalk detachably mounted in said recess, said front opening of said recess providing access to said chalk enabling a pool cue tip of felt to be engaged against said chalk cube for chalking the tip of the chalk.

* * * * *